US006598309B1

(12) United States Patent
Coombs

(10) Patent No.: US 6,598,309 B1
(45) Date of Patent: Jul. 29, 2003

(54) BOLT CENTRALIZER

(75) Inventor: Perry L. Coombs, Claremont, NH (US)

(73) Assignee: Oldenburg Cannon, Inc., Claremont, NH (US)

( * ) Notice: Subject to any disclaimer, the term of this patent is extended or adjusted under 35 U.S.C. 154(b) by 0 days.

(21) Appl. No.: 10/137,555

(22) Filed: Apr. 30, 2002

(51) Int. Cl.[7] ..... G01B 5/24; E21D 20/00
(52) U.S. Cl. ..... 33/644; 33/645; 405/303
(58) Field of Search ..... 33/613, 624, 626, 33/636, 637, 638, 644, 645; 173/13, 42, 45, 190; 405/259.1, 303

(56) References Cited

U.S. PATENT DOCUMENTS 4,351,625 A * 9/1982 Selestam et al. ..... 405/303
4,473,325 A 9/1984 Beney et al. ..... 405/303
4,497,378 A 2/1985 Beney et al. ..... 173/32
5,114,279 A 5/1992 Bjerngren et al. ..... 405/303
5,556,235 A 9/1996 Morrison et al. ..... 405/303
5,690,449 A 11/1997 Morrison et al. ..... 405/303
6,085,432 A * 7/2000 Van der Sluis et al. ..... 33/613
6,302,623 B1 * 10/2001 Nellson ..... 405/259.1
6,413,019 B1 * 7/2002 Coombs et al. ..... 405/303

* cited by examiner

*Primary Examiner*—G. Bradley Bennett
(74) *Attorney, Agent, or Firm*—Michael J. Weins; Jeffrey E. Sempreben

(57) ABSTRACT

A bolt centralizer for a rock bolter, which advances a bolt along a work axis, has a hand pivotably mounted on an arm so as to pivot between first and second hand positions. A pair of fingers is pivotably attached to the hand. When the fingers are in a closed position, they form a centralizer passage which is aligned with the work axis when the hand is in the first hand position. The hand is pivoted to the second hand position to remove the fingers from the bolt to allow a bolt plate and bolt driver to be advanced past the hand.

7 Claims, 9 Drawing Sheets

BOLT CENTRALIZER

BACKGROUND OF THE INVENTION

Rock bolters, independent of whether they are platform- or turret-type bolters, employ mechanisms to sequentially bring a drill and a bolt driver into alignment with a work axis which corresponds to the axis of the hole to be drilled and the bolt to be positioned therein. These mechanisms can be either a platform transfer device, such as taught in U.S. Pat. Nos. 5,114,279 and 5,690,449 or, alternatively, a turret transfer device such as is taught in U.S. Pat. Nos. 4,473,325 and 4,497,378. In either case, the drill is first aligned with the work axis and advanced to bore a hole into a desired location on a rock surface. The drill is withdrawn, and the bolt driver is then aligned with the work axis to advance the bolt into the hole. The bolt typically has a bolt plate associated therewith which is brought into contact with the rock surface when the bolt is fully inserted into the hole.

To assure that the bolt is accurately aligned with the axis of the drilled hole, a bolt centralizer, while not a necessity, is highly desirable. While a centralizer is desirable, the use of a centralizer does increase the complexity of the rock bolter. The centralizer should be, at least in part, positioned in close proximity to the hole and requires a bolt-directing element having a passage therethrough which needs to be in close proximity to the rock surface into which the hole is drilled. The introduction of a bolt centralizer presents two problems. The centralizer must not interfere with either the bolt driver or the bolt plate as the bolt driver is advanced, and the centralizer must have its bolt-directing element be retractable when the bolt is partially driven so that the bolt plate can be advanced to the rock surface.

The '378 patent teaches a rock bolter which does not employ a centralizer, but instead relies on a pair of grippers for holding the bolt as it is transferred from a bolt magazine into alignment with the hole, these grippers apparently also serving to guide the bolt into the hole bored in the rock. The grippers are described as being pivotably mounted, and thus presumably pivot out of the way as the bolt driver and the bolt plate are advanced, allowing the bolt plate to be advanced into contact with the rock surface. Accurate alignment of the bolt with the hole has been found problematic with such devices, frequently requiring the operator to adjust the position of the rock bolter visually to insert the bolt into the hole. Even when bolts having a tapered bolt tip to assist in inserting the bolt into the hole are employed, accurate alignment of the bolt with the hole is problematic.

The '325 patent, assigned to the same assignee as the '378 patent, teaches the use of a centralizer in combination with the rock bolter described in the '378 patent. The centralizer has a bolt-directing assembly with a bolt plate holder which positions the bold plate to allow the bolt plate to serve as the bolt-directing element. This approach requires the bolt plates to reside in close proximity to the rock surface, limiting the ability to store multiple bolts with the bolt plates residing thereon in a magazine when the rock bolter is intended for use in mines where the footprint of the front surface of the bolt magazine needs to be minimized to avoid interference with the surrounding rock surface during the bolt-setting operation. Also, since there are various configurations of bolt plates which are commonly used, a different holder would need to be used for different types. This would require alteration of the rock bolter when the plate type is changed, which is undesirable.

The '279 patent, which is for a platform-type rock bolter, employs an arm to help transfer the bolt to the work axis and may also use the arm to direct the bolt into the hole. The arm has a hydraulic cylinder that causes it to grip the bolt and a second hydraulic cylinder that pivots the arm about an axis parallel to the work axis. The '279 patent does not discuss how the arm is moved to allow the bolt plate to pass thereby. The use of two hydraulic cylinders to operate the arm complicates both the structure and the operation of the rock bolter.

Applicant's assignee has overcome the problem of centralizing the bolt for most situations with the use of a combination stinger/centralizer, as taught in U.S. No. Pat. 5,556,235 and U.S. Pat. No. 6,413,019, for both of which the present Applicant is a co-inventor. The stinger/centralizer has two mating heads which form the centralizer, and which can be separated and withdrawn to allow the bolt plate to be advanced therepast. While the stinger/centralizer has been advantageously employed in many situations, the use of a stinger/centralizer may not be practical when clearances are severely limited, as the stinger/centralizer increases the overall height of the rock bolter. Additionally, when the rock surface is extremely friable, it is preferred to use the bolts to secure a screen material to the rock surface to stabilize it, and the presence of a stinger/centralizer may result in interference with the apparatus for handling such screen material.

Thus, there is a need for a centralizer structure for maintaining alignment of a bolt with respect to a pre-drilled hole which is suitable for use in limited clearance situations and for use with a screen handling apparatus.

SUMMARY OF THE INVENTION

The present invention is for a bolt centralizer that has utility in rock bolters which have frames and employ either platforms or turrets attached to the frames to move a rock drill and a bolt driver onto and off of a work axis. The work axis is defined as the axis which is traversed by a drill steel while being advanced by the rock drill to form a hole at a desired location on a rock surface and the axis along which a bolt is advanced when the bolt is being driven into the hole by the bolt driver. Further descriptions of these rock bolters are found in U.S. Pat. Nos. 5,556,235 and 5,690,449, and in U.S. patent application Ser. No. 09/691,736, all of which are assigned the assignee of the present application.

The bolt centralizer of the present invention has an arm terminating in an arm first end and an arm second end. The arm first end is connected to the frame of the rock bolter. A bolt-directing hand having a hand first end and a hand second end is provided. The bolt directing-hand is pivotably attached to the arm second end so as to pivot about a hand pivot axis. This hand pivot axis is preferably normal to the work axis to allow the hand to pivot in an arc which is coplanar with the work axis.

A pair of fingers is pivotably attached to the hand second end such that the fingers pivot with respect to each other about a finger pivot axis between a closed position, where they are in a bolt-gripping relationship with respect to each other, and an open position, where they are in a bolt-releasing relationship. A spring is provided to bias the pair of fingers to the closed position. Preferably, the fingers are both pivotably mounted to the hand second end and share a common finger pivot axis that is positioned so as to swing through a plane which contains the work axis when the bolt-directing hand is pivoted about the hand pivot axis.

A recess is provided in each of the fingers and these recesses are configured and positioned such that, in combination, they form a centralizer passage when the fingers are in the closed position. The centralizer passage is sized to slidably engage the bolt when the bolt is positioned in the recesses and the fingers are in the closed position. Alternatively, when the fingers are in the open position, they are sufficiently separated as to allow the bolt to be passed into and out of the recesses.

Means for rotating the bolt-directing hand about the hand pivot axis are provided, and serve to rotate the bolt-directing hand between a first hand position, where the centralizer passage is alignable with the work axis, and a second hand position, where the hand and fingers are positioned so as not to obstruct the advancement of the bolt driver, a bolt plate mounted on the bolt, the rock drill, or a resin injector if one is employed. In the first hand position, the centralizer passage can be either in alignment with the work axis, when the bolt and the bolt driver are aligned therewith, or aligned only with the bolt and bolt driver when the bolt and the bolt driver are subsequently moved into alignment with the work axis. Preferably, the bolt-directing hand pivots such that the fingers are moved into closer proximity to the rock surface when the bolt-directing hand is moved from the first hand position to the second hand position. The means for rotating the hand are activated to move the hand from its second hand position to its first hand position to bring the fingers into engagement with the bolt or, alternatively, to bring the fingers to a position where the bolt engages the fingers as the bolt is advanced. The engagement of the fingers with the bolt serves to guide the bolt to facilitate implanting a bolt tip of the bolt into the hole which has previously been drilled along the work axis, since the centralizer passage is aligned with the work axis when the hand in the first hand position. After the bolt has been partially inserted into the hole, the means for rotating the hand are activated to move the hand to its second hand position, forcing the fingers to release the bolt and moving the hand and fingers off the work axis to allow the bolt driver to further advance the bolt to bring the bolt plate into contact with the rock surface.

Means for locking the bolt-directing hand in the first hand position are provided to assure that the alignment of the centralizer passage remains true as the bolt is being directed into and through the centralizer passage of the bolt centralizer. Preferably, the means for locking the bolt-directing hand in the first hand position are incorporated into the means for rotating the bolt-directing hand.

To further facilitate the engagement of the bolt with the bolt centralizer, it is preferred that the centralizer passage terminate in a beveled surface positioned to guide the bolt into the centralizer passage as the bolt approaches the fingers. The bolt can approach the fingers either as the bolt-directing hand is pivoted toward its first position or, when the bolt-directing hand is separated from the bolt when in its first position, as the bolt is advanced by the bolt driver. It is further preferred that the centralizer passage terminate in a beveled surface at its other end to reduce the torsional load required to open the fingers to release the bolt. If the bevels are the same, this brings an additional advantage in that symmetrical fingers can be used to reduce the number of parts that need to be maintained in inventory for repair.

It is also preferred for the fingers to each have a finger terminating region through which the bolt passes as the fingers are either swung onto or off of the bolt. These finger terminating regions each have a sloped surface adjacent the centralizer passage and secondary bevels which intersect the sloped surface. The sloped surfaces slope toward the centralizer passage and serve as ramp surfaces to force the fingers to their open position when the hand is pivoted from its first hand position to its second hand position to disengage the fingers from the bolt. The sloped surfaces can also assist in guiding the bolt into the centralizer passage when the bolt tip is misaligned with the work axis and the hand is pivoted into engagement with the bolt as it pivots from its second hand position to its first hand position. The secondary bevels may also assist in removing the fingers from the bolt, but primarily serve to force the fingers open in situations where the bolt tip is misaligned and the fingers are swung over the tip of the bolt as the hand is pivoted from its second hand position to its first hand position. Forcing the fingers toward their open position allows the bolt tip to engage the sloped surfaces and be guided into the centralizer passage. Alternatively, when shorter bolts are employed and the bolt tip is substantially aligned with the work axis, the recesses may be brought over the end of the bolt without requiring the fingers to be forced open, or the fingers may be brought to a position where they are interposed between the end of the bolt and the hole such that the bolt is brought into engagement with the fingers as it is advanced. Again, it is preferred for the fingers to be symmetrical.

While various actuators or mechanisms could be employed to provide means for rotating the bolt-directing hand between the first hand position and the second hand position, it has been found convenient to employ a linear actuator having an actuator first end and an actuator second end to provide the means. The linear actuator has the actuator first end pivotably connected to the hand while the actuator second end is pivotably connected to a structural element of the rock bolter which remains in a fixed relationship with respect to the arm. The use of a linear actuator has a second benefit when the actuator provides a firm maximum extension, in which case the actuator can also serve as the means for locking the hand in the first hand position.

BRIEF DESCRIPTION OF THE FIGURES

FIG. 6 shows the bolt centralizer when the hand is in its second hand position and shows, in phantom, the bolt-directing hand as it approaches its first hand position to bring the fingers into engagement with a bolt in the bolt magazine.

BEST MODE OF CARRYING THE INVENTION INTO PRACTICE

Figure 1:
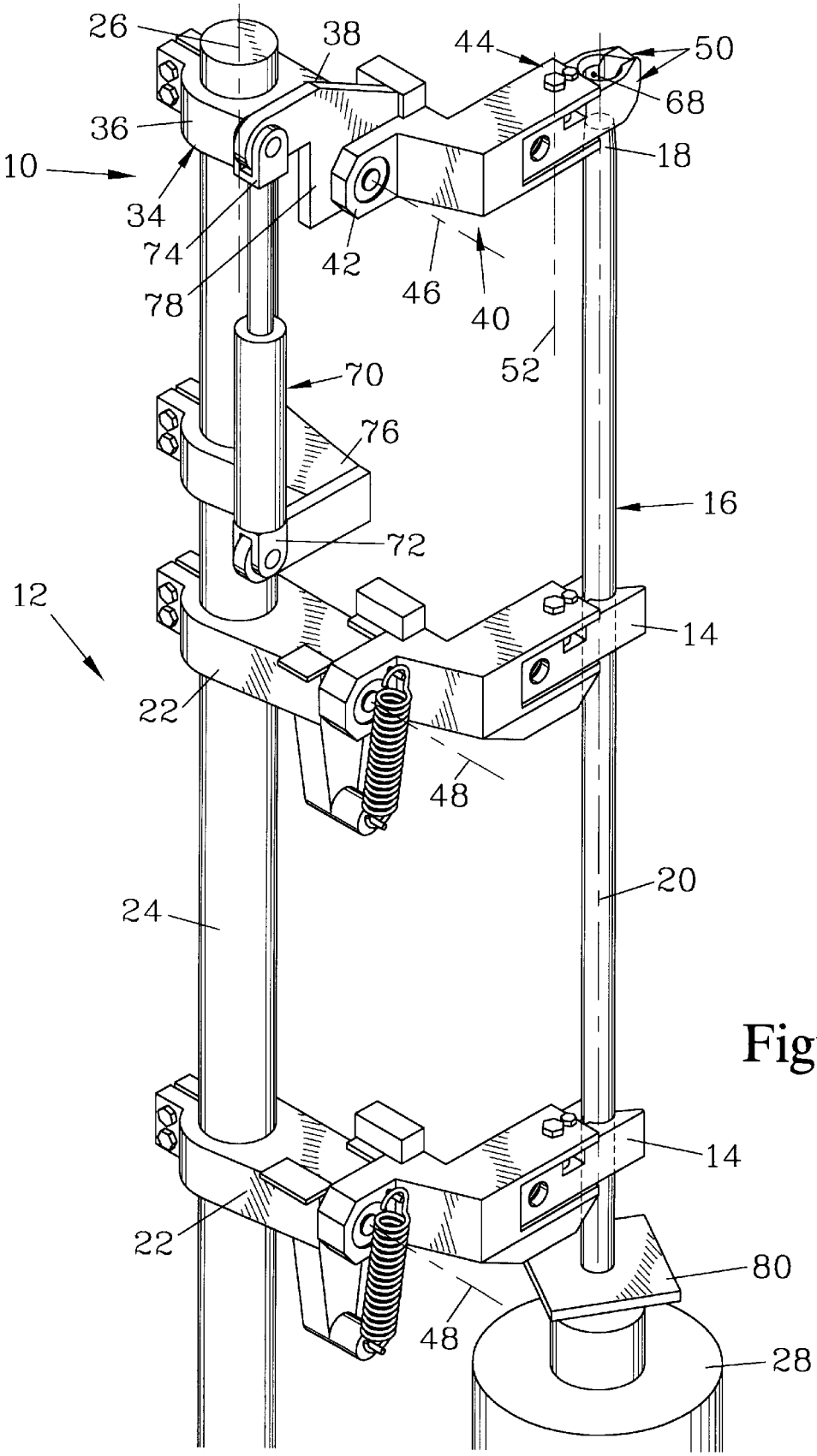
FIG. 1 is an isometric view illustrating a bolt centralizer which forms one embodiment of the present invention. The bolt centralizer is illustrated mounted to a turret-type rock bolter, which is only partially shown. The rock bolter has a pair of bolt-receiving arms which engage a bolt to transfer the bolt to a work axis. In this embodiment, the bolt centralizer does not initially engage the bolt when a bolt-directing hand is in a first hand position, as shown in FIG. 1, but rather the bolt centralizer is engaged by the bolt as the bolt is advanced along the work axis by a bolt driver.
Figure 2:
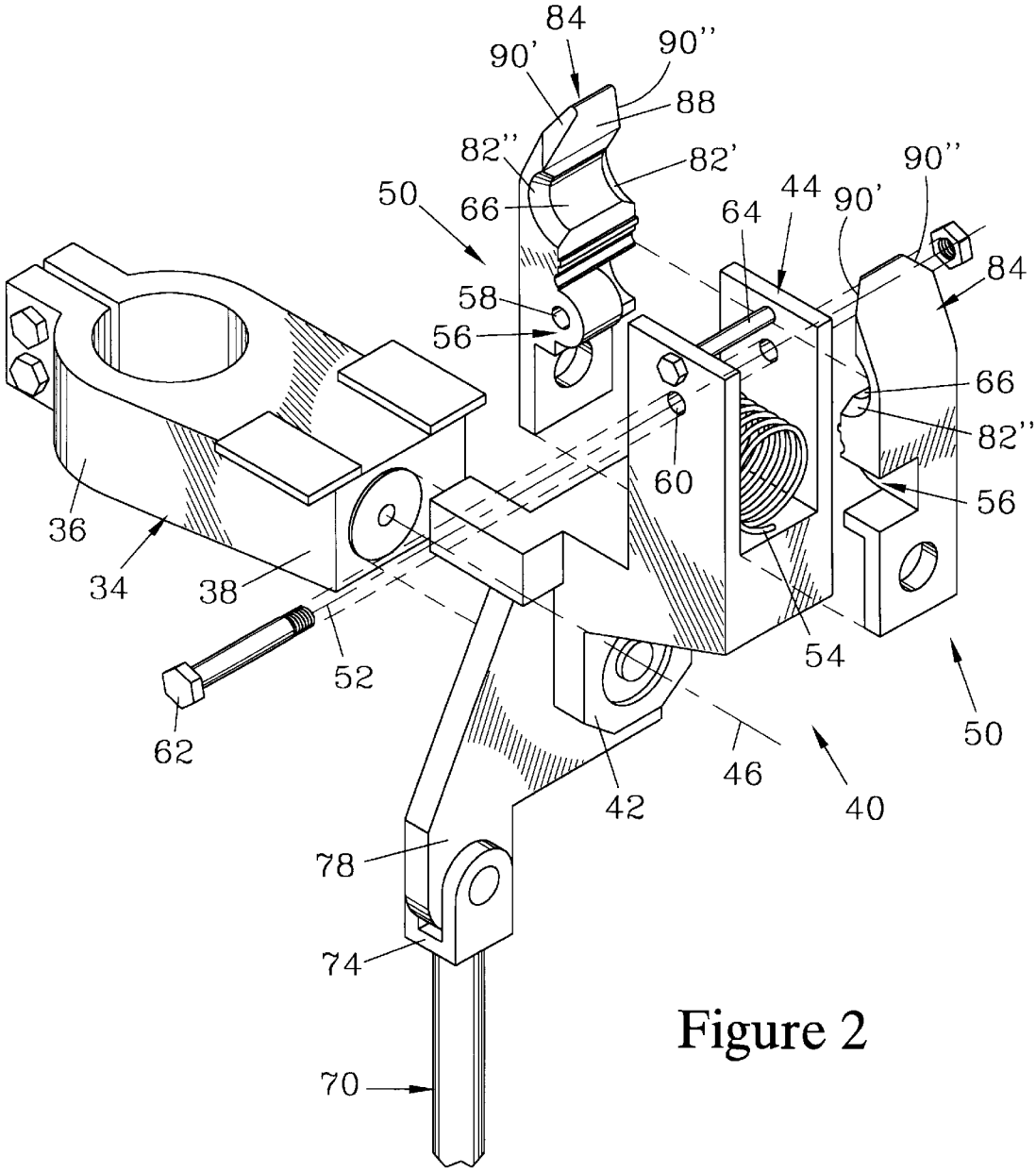
FIG. 2 is an exploded view of the centralizer shown in FIG. 1 when the bolt-directing hand is in a second hand position. The centralizer has an arm, to which the bolt-directing hand is pivotably mounted. A pair of fingers in turn are pivotably mounted to the bolt-directing hand such that they can pivot with respect to each other between a closed and an open position. A spring is provided to bias the fingers to the closed position.

FIGS. 1 through 5 illustrate a bolt centralizer 10 that forms one embodiment of the present invention. FIGS. 1 and 3–5 illustrate the bolt centralizer 10 at various points in the bolt-setting procedure, while FIG. 2 is an exploded view showing further details of the bolt centralizer 10. The bolt centralizer 10 as illustrated is integrated into a turret rock bolter 12 (only partially shown) such as described in co-pending U.S. patent application Ser. No. 09/691,736, assigned to the assignee of the present application and incorporated herein by reference. In this rock bolter 12, a pair of bolt-gripping hands 14 is employed to grip a bolt 16 having a tapered bolt tip 18 while the bolt 16 resides in a magazine (not shown), and to rotate the bolt 16 onto a work axis 20, the position illustrated in FIGS. 1, and 3–5. This rotational action is provided by mounting the pair of bolt-gripping hands 14 to a pair of bolt support arms 22 attached to a pivot shaft 24 which forms a part of a turret which in turn is rotatably mounted to a frame (not shown) of the rock bolter 12. The pivot shaft 24 resides on a rotational axis 26 (shown in FIG. 1) about which the turret rotates. The bolt centralizer 10, in combination with the bolt-gripping hands 14 and a bolt driver 28, guides the bolt 16 as the bolt 16 is advanced to insert the bolt tip 18 into a bolt hole 30 (shown in FIGS. 4 and 5) which has been prepared for the bolt 16 in a rock mass 32. The bolt centralizer 10 continues to guide the bolt 16 as it is further advanced into the bolt hole 30 by the bolt driver 28.

As best shown in the exploded view of FIG. 2, the bolt centralizer 10 has an arm 34 having an arm first end 36 and an arm second end 38, with the arm first end 36 being mounted to the pivot shaft 24. While the arm 34 could be mounted to other elements of the rock bolter 12, such as being mounted directly to the frame to which the pivot shaft 24 is rotatably mounted, having the arm 34 mounted to the pivot shaft 24 has advantages for a turret-type rock bolter, in that it coordinates the motion of the arm 34 with the motion of the pair of support arms 22.

A bolt-directing hand 40 is provided, having a hand first end 42 and a hand second end 44. The hand first end 42 is pivotably attached to the arm second end 38 so as to pivot about a hand pivot axis 46 between a first hand position, shown in FIGS. 1 and 3, and a second hand position, shown in FIGS. 2 and 5. Preferably, the hand pivot axis 46 is parallel to gripper pivot axes 48 (shown in FIGS. 1, 3, and 5) about which the bolt-gripping hands 14 rotate. FIG. 4 shows the bolt centralizer 10 when the bolt-directing hand 40 has been pivoted partway from the first hand position to the second hand position.

Figure 3:
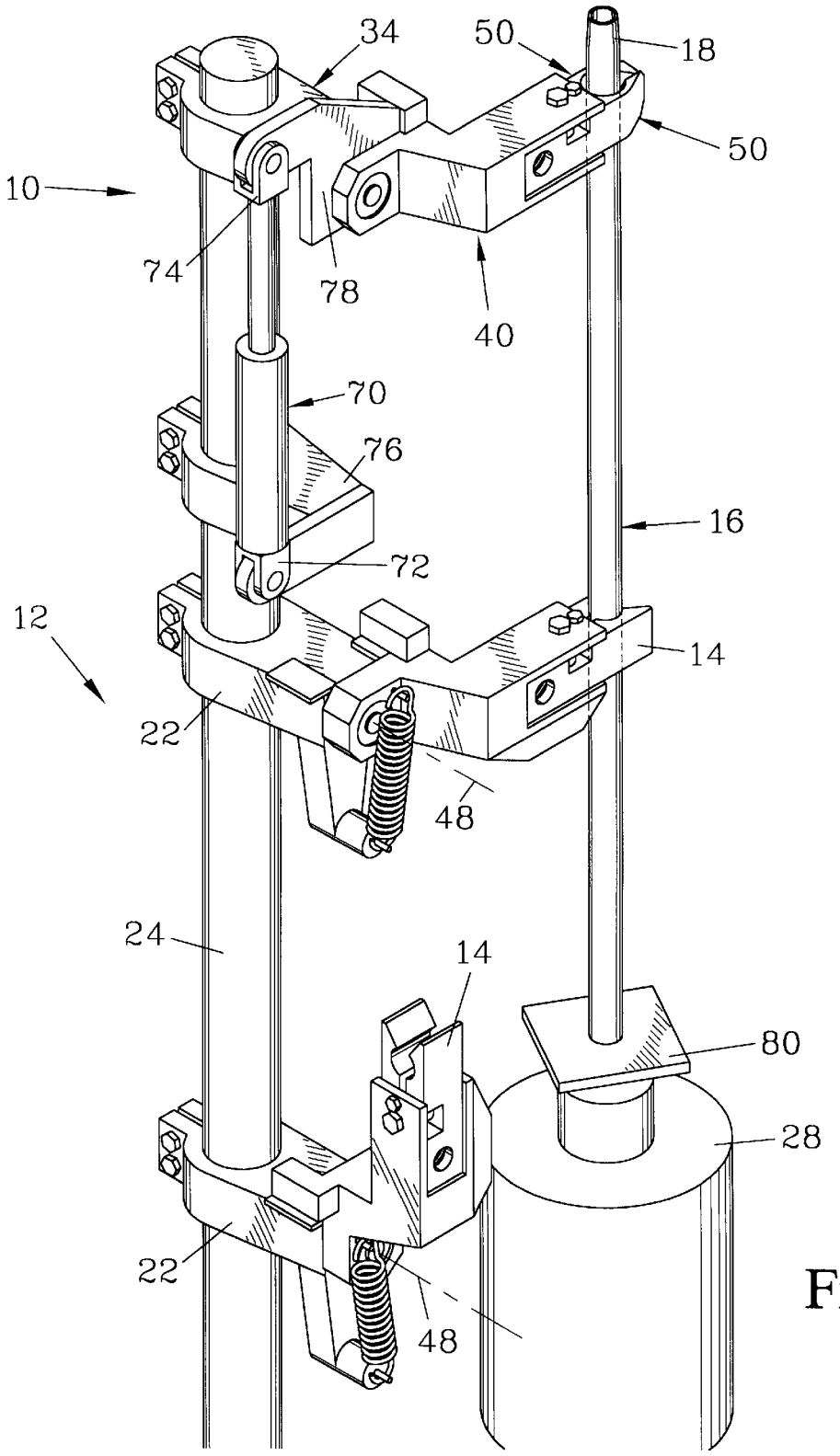
FIG. 3 shows the embodiment shown in FIG. 1 when a bolt driver has been activated to advance the bolt towards the hole. As the bolt advances, it becomes slidably engaged with a centralizer passage formed by recesses in the fingers of the bolt-directing hand. The bolt-directing hand is rigidly maintained in the first hand position by a linear actuator to assure that the centralizer passage remains aligned with the work axis to direct the bolt into the hole.
Figure 4:
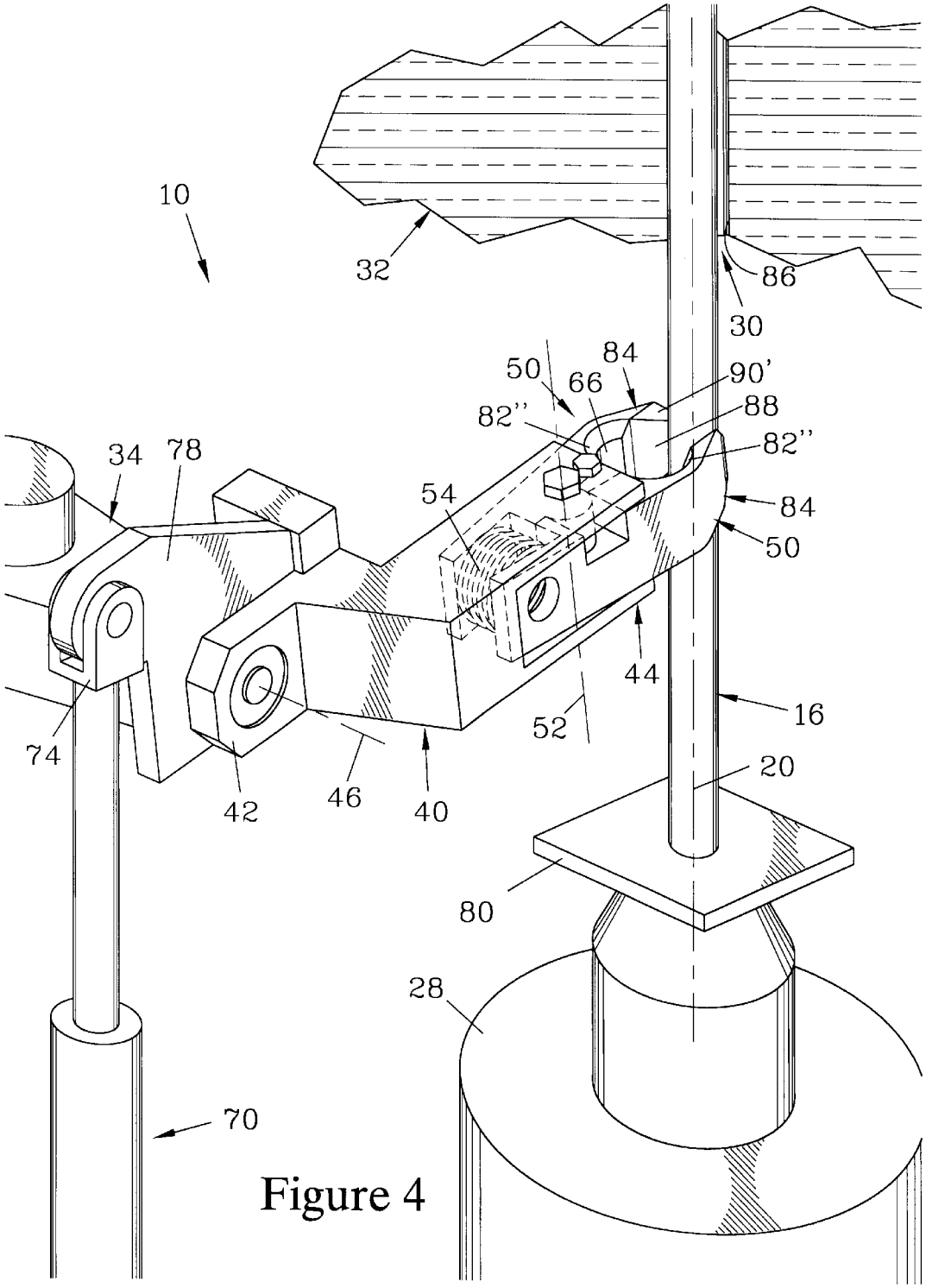
FIG. 4 illustrates the bolt centralizer shown in FIGS. 1–3 when the linear actuator has been activated to begin moving the bolt-directing hand about a hand pivot axis to its second hand position (shown in FIG. 5). In the intermediate position shown in FIG. 4, the fingers have been forced to their open position by the rotation of the bolt-directing hand to allow removal of the bolt from the fingers.
Figure 5:
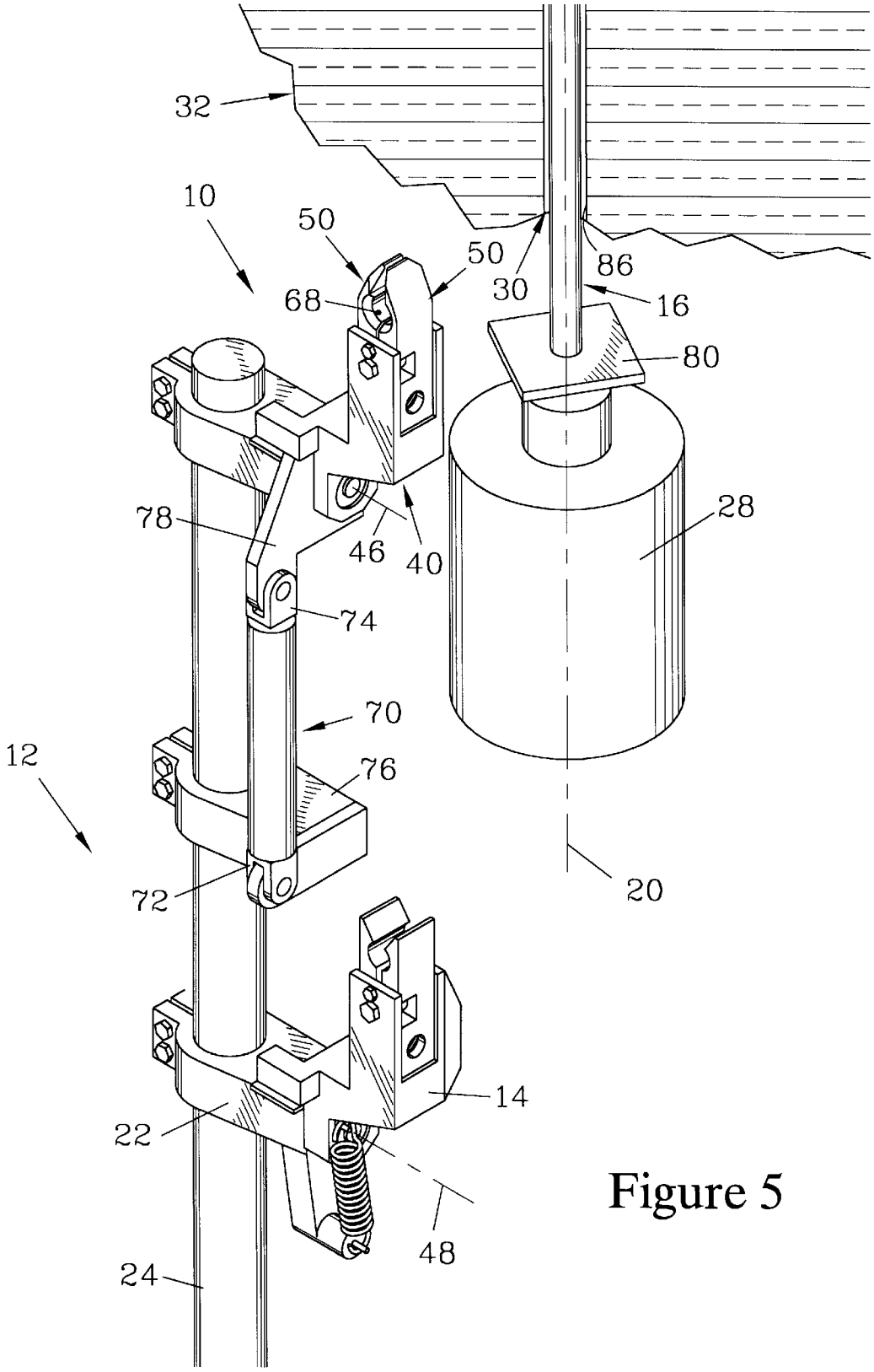
FIG. 5 shows the embodiment shown in FIGS. 1–4 when the linear actuator has moved the bolt-directing hand about the hand pivot axis to the second hand position. In the second hand position, the hand and fingers are spaced apart from the work axis to provide clearance for the bolt driver to advance a bolt plate therepast. The fingers have been biased to their closed position by the spring.
Figure 6:
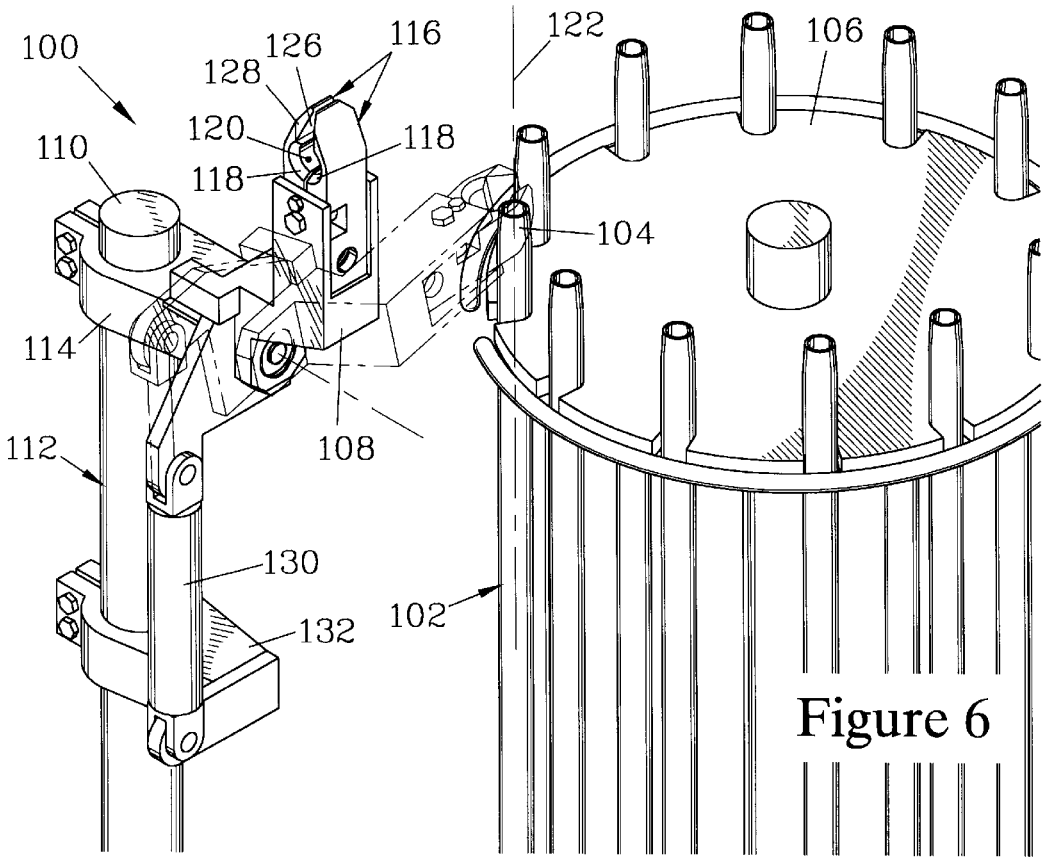
FIG. 6 is an isometric view of a bolt centralizer which is essentially similar to the embodiment shown in FIGS. 1–5. This embodiment is mounted to a rock bolter (only partially shown) having a rotary bolt magazine.
Figure 7:
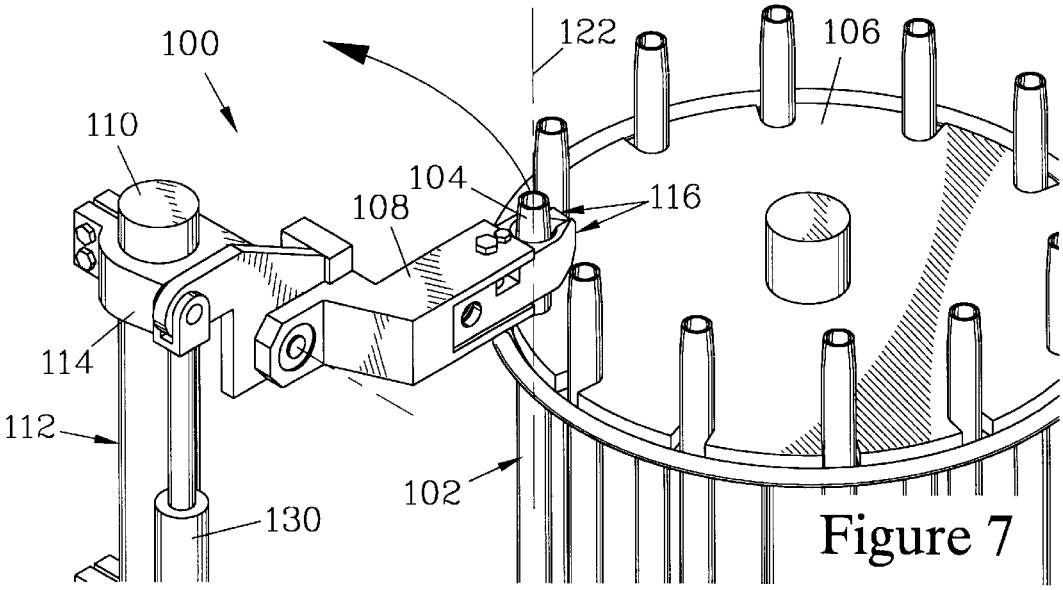
FIG. 7 shows the bolt centralizer shown in FIG. 6 when the linear actuator has been activated to move the hand to its first hand position. In this embodiment, the movement of the hand to its first hand position also acts to bring the fingers of the hand into engagement with one of the bolts in the bolt magazine. The bolt centralizer can then assist in transferring the bolt from the bolt magazine to a work axis.

A pair of fingers 50 are pivotably attached to the hand second end 44 such that the fingers 50 pivot about a common finger pivot axis 52 (shown in FIGS. 1 and 4) between a closed position, illustrated in FIGS. 1, 3 and 5, and an open position, illustrated in FIG. 4. It is preferred that the finger pivot axis 52 be substantially normal to the hand pivot axis 46 and, more preferably, be oriented such that the finger pivot axis 52 swings in a plane containing the work axis 20 as the bolt-directing hand 40 rotates about the hand pivot axis 46. The fingers 50 are biased to the closed position by a spring 54 which, as illustrated, is a coil spring; however, other springs such as torsional or leaf spring could be employed.

In the embodiment illustrated, the fingers 50 each have a finger pivot lug 56 (shown in FIG. 2) having a finger pivot passage 58 (only one of which is shown) therethrough. The finger pivot passages 58 are aligned with each other and with a hand pivot passage 60 through the hand second end 44, and the fingers 50 are attached to the hand second end 44 by a hand pivot bolt 62 passing through the finger pivot passages 58 and the hand pivot passage 60. A finger centering bolt 64 is preferably also provided in the hand second end 44. The finger centering bolt 64 limits the pivotable motion of each of the fingers 50 about the finger pivot axis 52 to maintain the fingers 50 symmetrically disposed with respect to the hand second end 44.

A recess 66 (labeled in FIGS. 2 and 4) is provided in each of the fingers 50. The recesses 66 are positioned and configured such that, when the fingers 50 are in the closed position, the recesses 66 in combination form a centralizer passage 68 (shown in FIGS. 1 and 5) sized to slidably engage the bolt 16 as it is advanced through the bolt centralizer 10. When the bolt-directing hand 40 is in the first hand position, the centralizer passage 68 is aligned with the bolt driver 28 and, when the turret has been positioned to align the bolt driver 28 with the work axis 20, the centralizer passage 68 is also aligned with the work axis 20. In this embodiment, it is preferred for the bolt-directing hand 40 to be pivoted from its second hand position to its first hand position while the bolt 16 and the bolt driver 28 reside on the work axis 20.

In the embodiment illustrated in FIGS. 1–5, the bolt centralizer 10 is spaced apart from the bolt-gripping hands 14 and in close proximity to a distal end of the rock bolter 12. This assures that the bolt centralizer 10 can be positioned in close proximity to the bolt hole 30 into which the bolt 16 is to be set by positioning the rock bolter 12. The position of the rock bolter 12 can be maintained by a boom (not shown), and may be additionally stabilized by a stinger (not shown), in the manner well known in the art.

If the bolt-directing hand 40 is in the first hand position when the rock bolter 12 is positioned, care should be taken to assure that the bolt centralizer 10 is sufficiently spaced from the rock mass 32 to allow the bolt-directing hand 40 to be moved to its second hand position since, in this embodiment, the bolt-directing hand 40 and the fingers 50 are swung towards the rock mass 32 when the bolt-directing hand 40 is moved to its second hand position. In the embodiment illustrated, the bolt-directing hand 40 is positioned such that it can be placed in the first hand position without bringing the fingers 50 into engagement with the bolt 16. In this case, the bolt 16 is brought into engagement with the centralizer passage 68 when advanced by the bolt driver 28.

The bolt centralizer 10 employs a hydraulic cylinder 70 as a linear actuator that serves as a means for rotating the bolt-directing hand 40 about the hand pivot axis 46. The hydraulic cylinder 70 has a cylinder first end 72 and a cylinder second end 74. The cylinder first end 72 is pivotably attached to a brace 76 which in turn is affixed to the pivot shaft 24, while the cylinder second end 74 is pivotably attached to a tab 78 attached to the hand first end 42.

When the hydraulic cylinder 70 is in its extended position, as illustrated in FIGS. 1 and 3, the bolt-directing hand 40 is in the first hand position, where the central passage 68 formed by the fingers 50 is aligned with the work axis 20. Conversely, when the hydraulic cylinder 70 is in its retracted position illustrated in FIG. 5, the bolt-directing hand 40 and the fingers 50 have been swung to the second hand position where they are positioned such that the bolt 16 and an associated bolt plate 80, as well as the bolt driver 28, can pass alongside without interference. When the hydraulic cylinder 70 has a sufficiently stiff action, then the hydraulic cylinder 70 remains in the extended position until the hydraulic pressure is adjusted to drive the hydraulic cylinder 70 to its retracted position. In such cases, the hydraulic cylinder 70 also serves as means for locking the bolt-directing hand 40 in the first hand position where the bolt-directing hand 40 is positioned to engage the bolt 16.

It is preferred for the centralizer passage 68 to terminate in beveled surfaces 82 (shown in FIGS. 2 and 4) to facilitate the advancement of the bolt 16 into the centralizer passage 68. The beveled surfaces 82' (one of which is shown in FIG. 2) that face towards the bolt 16 when the bolt-directing hand 40 is in its first hand position act to guide the bolt tip 18 into the centralizer passage 68 when the bolt 16 is advanced by the bolt driver 28 to bring the bolt 16 into engagement with the fingers 50.

Companion beveled surfaces 82", which face away from the bolt 16 when the bolt-directing hand 40 is in its first hand position and before the bolt 16 has been advanced, are preferably also provided. These beveled surfaces 82" provide two benefits; the beveled surfaces 82" make it possible to provide symmetrical fingers 50 to reduce the inventory of parts to be maintained, and the inclusion of the companion beveled surfaces 82" reduces the bending moment on the bolt 16 when the bolt-directing hand 40 is removed from the bolt 16 by pivoting it from its first hand position to its second hand position. When the bolt-directing hand 40 is pivoted from its first hand position to its second hand position, the bolt 16 passes between finger terminating regions 84 (labeled in FIGS. 2 and 4) on the fingers 50, forcing the fingers 50 against their bias to the open position as discussed below.

FIG. 4 illustrates the bolt 16 where it has been advanced a substantial distance into the bolt hole 30 and is in an intermediate position between the positions illustrated in FIGS. 3 and 5. The bolt 16 has moved beyond the pair of bolt-gripping hands 14 and is supported by a wall 86 of the bolt hole 30 and by the bolt driver 28. In order to complete the bolt driving step and bring the bolt plate 80 into engaging contact with the rock mass 32, the bolt-directing hand 40 and the pair of fingers 50 attached thereto must be moved out of the path of the advancing bolt plate 80 and the bolt driver 28. This is done by the hydraulic cylinder 70 as it moves from its extended position, illustrated in FIGS. 1 and 3, to its retracted position, illustrated in FIG. 5. In the intermediate position illustrated in FIG. 4, the bolt-directing hand 40 has begun its rotation and, by providing the bevel surfaces 82' and 82", the torsional load on the bolt 16 is reduced as the fingers 50 are rotated.

Sloped surfaces 88 (shown in FIGS. 2 and 4) on the finger terminating regions 84 facilitate the removal of the bolt 16 by spreading the fingers 50 to their open position (shown in FIG. 4) to allow the bolt 16 to pass out of the recesses 66. Secondary bevels 90 that intersect the sloped surfaces 88 are preferably also provided. The secondary bevels 90' (shown in FIGS. 2 and 4) reduce the angle of engagement between the bolt 16 and the fingers 50 when the fingers 50 are spread against the bias of the spring 54 during removal of the bolt 16. The secondary bevels 90" not only provide symmetry for the fingers 50, but also help to guide the bolt tip 18 into the centralizer passage 68 in the event that the bolt tip 18 is misaligned with the work axis 20, allowing the bolt 16 to engage the centralizer passage 68 as the bolt driver 28 is advanced.

FIGS. 6 through 14 illustrate another embodiment of the present invention, a bolt centralizer 100 which serves to centralize the bolt setting procedure in a manner similar to that of the bolt centralizer 10 discussed above. The bolt centralizer 100 also serves to help transfer a bolt 102 having a tapered bolt tip 104 from a bolt magazine 106 to a work axis (not shown), by serving the function of one of the pair of bolt-gripping hands 14 of the embodiment illustrated in FIGS. 1 through 5.

The centralizer 100 has a bolt-directing hand 108 that substitutes for the bolt-gripping hand 14 which would be closest to a distal end 110 of a pivot shaft 112 of a turret (not shown). The bolt-directing hand 108 pivots to a position which is outside the confines of the bolt magazine 106. The centralizer 100 in this embodiment is more limited in its guiding ability, since the bolt-directing hand 108 is further displaced from the rock surface (not shown) into which the bolt 102 is to be set than is the bolt-directing hand 40 of the bolt centralizer 10.

The centralizer 100 is structurally similar to the bolt centralizer 10 discussed above, and again has an arm 114 that is mounted to the pivot shaft 112 (shown in FIGS. 6 and 7), and to which the bolt-directing hand 108 is pivotably attached. The bolt-directing hand 108 swings between a first hand position, shown in FIGS. 7, 10, and 14, and a second hand position, shown in FIG. 6. FIGS. 8, 9, and 11–13 show the bolt-directing hand 108 when it has been pivoted partway from the second hand position to the first hand position, as is also shown in phantom in the view of FIG. 6.

A pair of fingers 116 are pivotably attached to the bolt-directing hand 108 so as to pivot between a closed position, where recesses 118 in the fingers 116 form a centralizer passage 120 (shown in FIGS. 6 and 9), and an open position, where the bolt 102 can be released from the fingers 116. The fingers 116 are again biased to the closed position. When the bolt-directing hand 108 is in its first hand position, shown in FIGS. 7, 10, and 14, the centralizer passage 120 is aligned with a bolt driver axis 122 on which the bolt 102 and a bolt driver (not shown) are positioned. The bolt driver axis 122 is brought into alignment with the work axis (not shown) when the pivot shaft 112 is rotated, and the centralizer passage 120 and the bolt 102 are also brought into alignment with the work axis.

Figure 8:
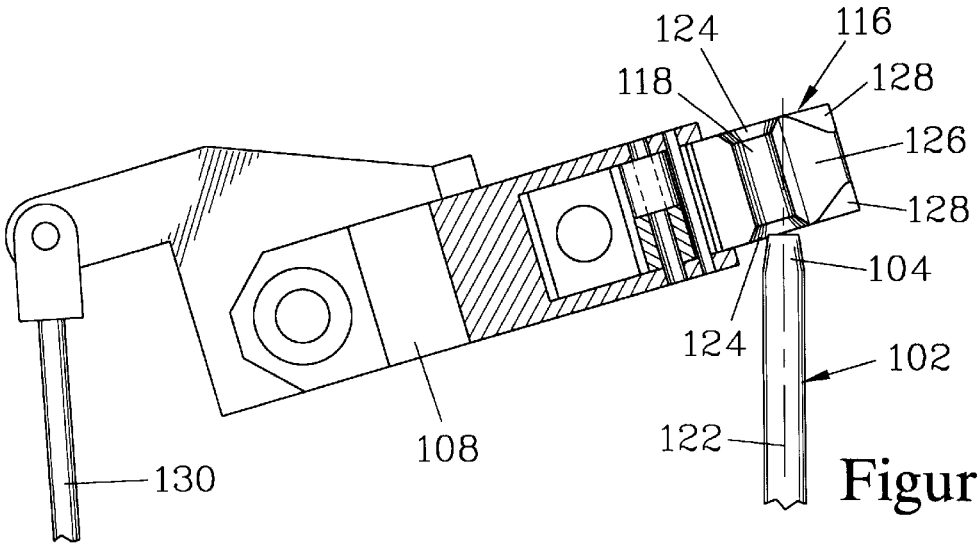
FIGS. 8 through 10 are section views that illustrate sequential positions of the bolt-directing hand and the fingers of the embodiment shown in FIGS. 6 and 7 as the bolt-directing hand is brought to its first hand position (shown in FIG. 10) and into engagement with the bolt.
Figure 9:
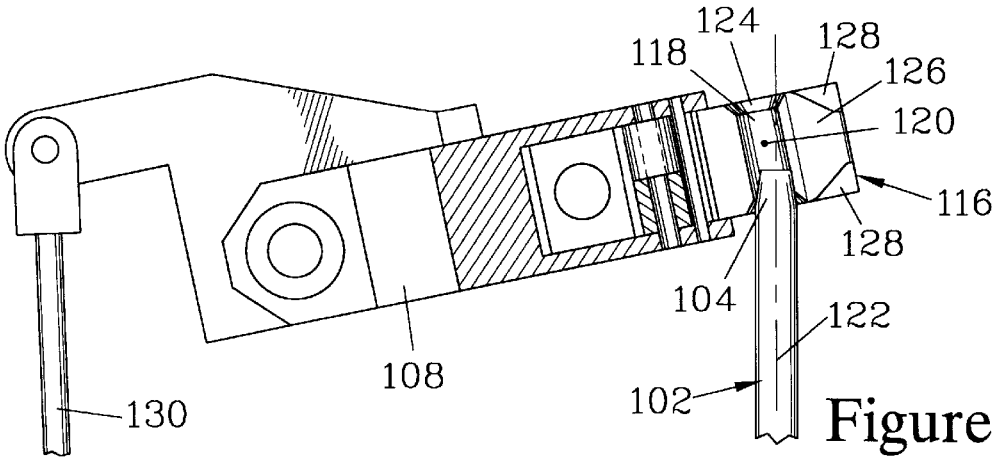
Figure 10:
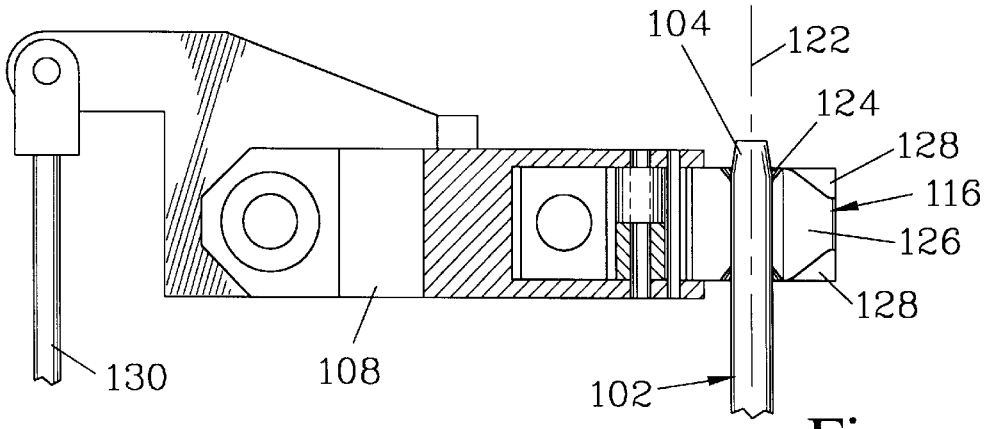

It is again preferred for the centralizer passage 120 to terminate in beveled surfaces 124, in this case to assist in placing the centralizer passage 120 over the bolt 102 when the bolt-directing hand 108 is pivoted from the second hand position to the first hand position. As shown in FIGS. 8–10, the beveled surfaces 124 guide the bolt 102 into the centralizer passage 120 as the bolt-directing hand 108 is pivoted. It should be noted that, in this embodiment, the fingers 116 are brought into engagement with the bolt 102 as the bolt-directing hand 108 is brought to the first hand position, and thereafter can assist in removing the bolt 102 from the bolt magazine 106 when the pivot shaft 112 is rotated to move the bolt 102 and the centralizer passage 120 into alignment with the work axis. The beveled surfaces 124 also facilitate removing the bolt 102 from the fingers 116, in the same manner as the beveled surfaces 82 discussed above.

Figure 11:
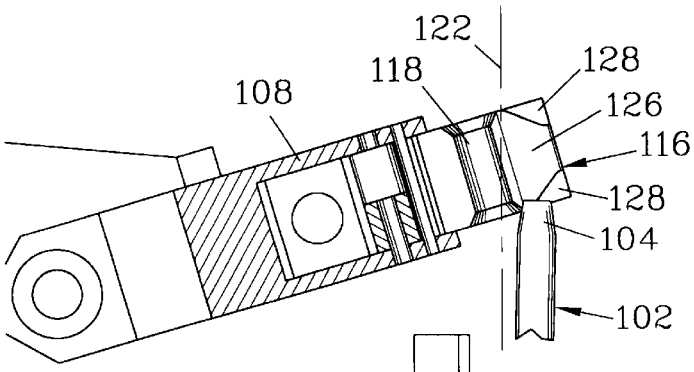
FIGS. 11 through 14 illustrate the same sequential positions of the bolt-directing hand and the fingers shown in FIGS. 8–10, but when a bolt tip of the bolt is misaligned with a bolt driver axis of the bolt driver. Sloped surfaces and secondary bevels cause the fingers to spread and guide the bolt tip into a centralizer passage formed by the fingers in their closed position.
Figure 12:
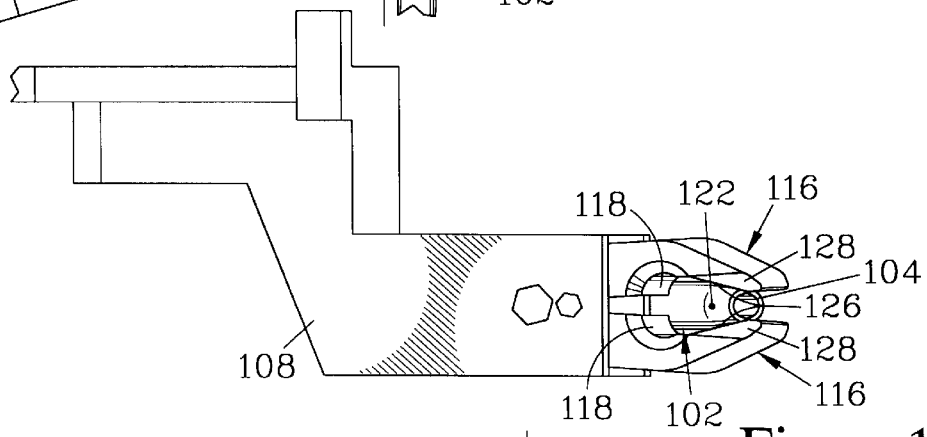
Figure 13:
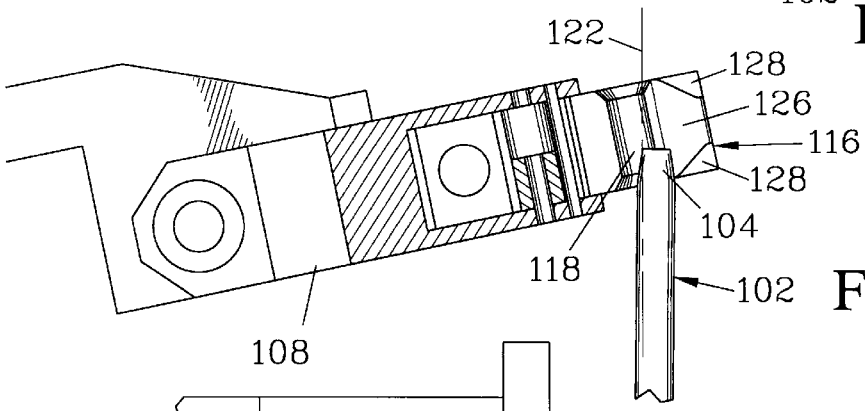
Figure 14:
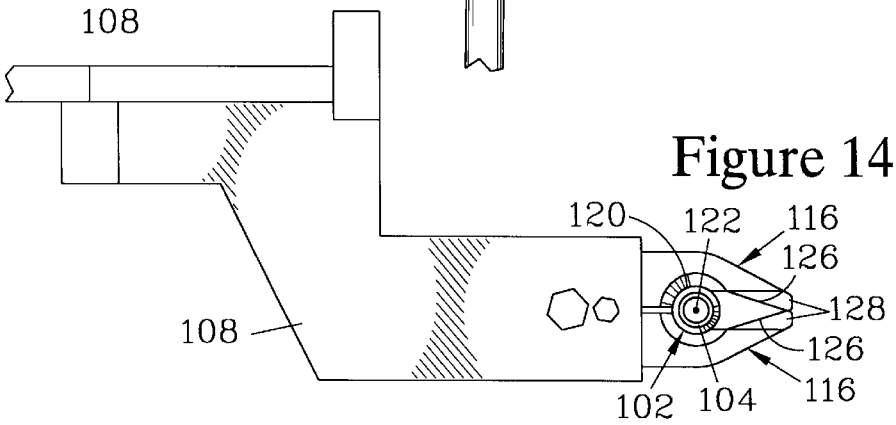

The fingers 116 are preferably also provided with sloped surfaces 126 and secondary bevels 128 to assist in spreading the fingers 116 to their open position to remove the bolt 102 from the recesses 118. The sloped surfaces 126 and the secondary bevels 128 also serve to facilitate engaging the bolt tip 104 and guiding it into the centralizer passage 120 in the event that the bolt tip 104 is not aligned with the bolt driver axis 122 when the bolt-directing hand 108 is swung to its first position, as shown in FIGS. 11–14. FIGS. 11 and 12 are, respectively, section and top views of the bolt-directing hand 108 and the fingers 116 when they are in the same intermediate position shown in FIG. 8, but where the bolt tip 104 is not aligned with the bolt driver axis 122. In this situation, the secondary bevels 128 engage the bolt tip 104 as the bolt-directing hand 108 moves towards its first hand position, and this engagement causes the fingers 116 to be forced towards the open position against their bias. This spreading of the fingers 116 allows the bolt-directing hand 108 to continue to pivot toward its first hand position, bringing the bolt tip 104 past the secondary bevels 128 and into engagement with the sloped surfaces 126, as shown in the section view of FIG. 13. As the bolt tip 104 passes the secondary bevels 128, the bias of the fingers 116 causes the sloped surfaces 126 to force the bolt tip 104 into the recesses 118. When the bolt-directing hand 108 reaches its first hand position, shown in the section view of FIG. 10 and in the top view of FIG. 14, the bolt 102 has been guided into the recesses 118 that form the centralizer passage 120 and is maintained therein by the bias of the fingers 116 until such time as the bolt-directing hand 108 is subsequently moved to its second hand position.

A hydraulic cylinder 130 (best shown in FIG. 6) is pivotably connected to the bolt-directing hand 108 and to a brace 132 mounted to the pivot shaft 110. The hydraulic cylinder 130 is again employed as a means for rotating the bolt-directing hand 108 and as a means for locking the bolt-directing hand 108 in the first hand position when the hydraulic cylinder 130 is extended.

Figure 15:
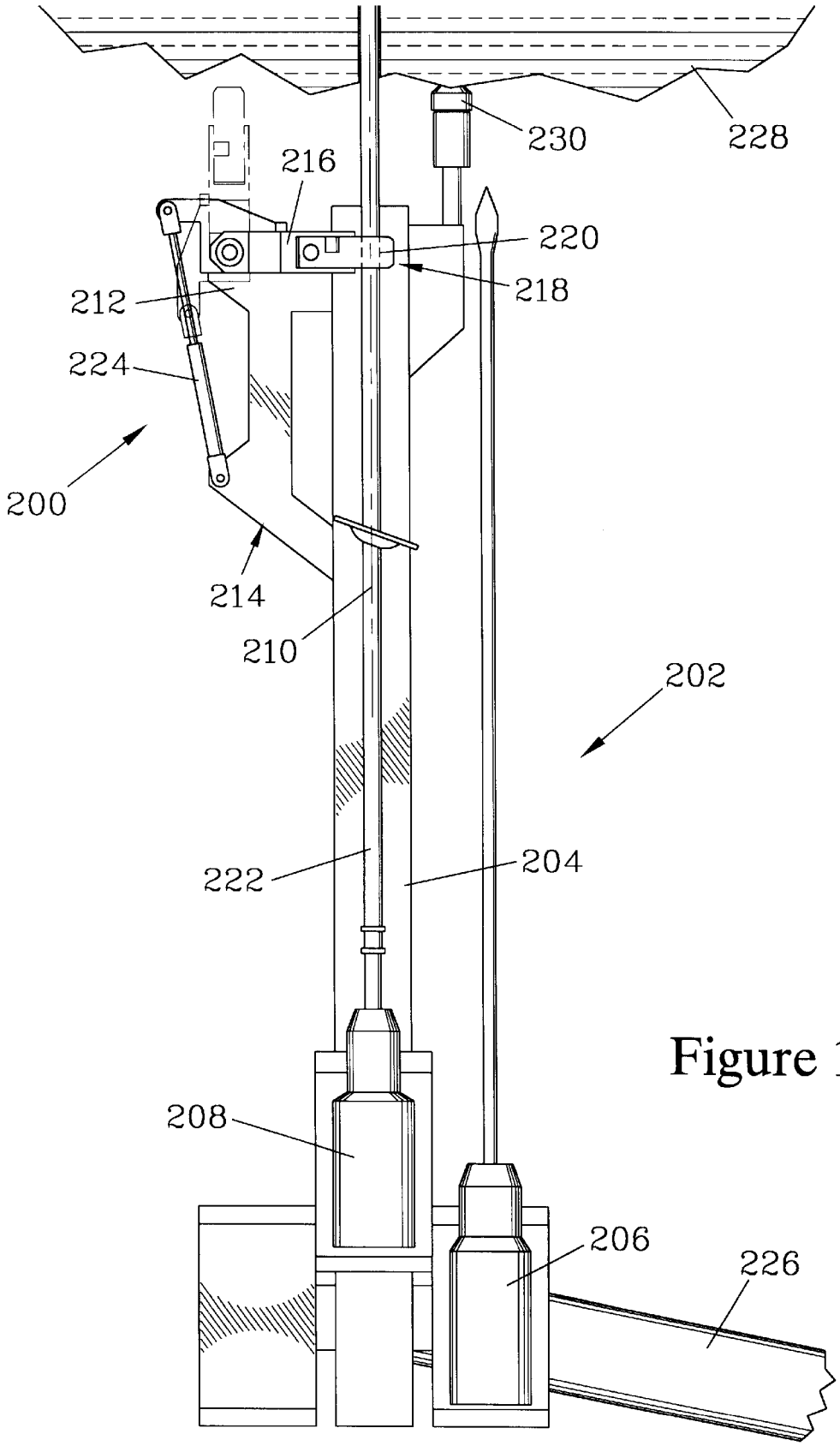
FIG. 15 is a plan view of another embodiment of the present invention, a centralizer that is employed on a platform-type rock bolter. This embodiment has an arm that is formed as part of a bracket affixed to a feed shell of the rock bolter.

FIG. 15 illustrates another embodiment of the present invention, a bolt centralizer 200 that is designed for use with a platform-type rock bolter 202. The rock bolter 202 has a single feed shell 204 along which a rock drill 206 and a bolt driver 208 are sequentially advanced, the feed shell 204 defining a work axis 210.

The centralizer 200 is structurally similar to the centralizers (10 and 100) discussed above, but has an arm 212 that is mounted to the feed shell 204. In this embodiment, the arm 212 is formed as part of a bracket 214 that is affixed to the feed shell 204. Again, a bolt-directing hand 216 is pivotably attached to the arm 212 so as to move between a first hand position, as illustrated, and a second hand position, shown in phantom. A pair of fingers 218 are pivotably attached to the bolt-directing hand 216 so as to pivot between a closed position, where the fingers 218 form a centralizer passage 220 to stabilize and guide a bolt 222 advanced by the bolt driver 208, and an open position, where the bolt 222 can be released from the fingers 218. In the centralizer 200, the centralizer passage 220 is aligned with the work axis 210 when the bolt-directing hand 216 is in its first hand position.

A hydraulic cylinder 224 is pivotably connected to the bolt-directing hand 216 and to the bracket 214 at a location spaced apart from the arm 212. The hydraulic cylinder 224 can again be extended or retracted so as to provide a means for rotating the bolt-directing hand 216 and, when extended, can provide a means for locking the bolt-directing hand 216 in the first hand position.

The rock bolter 202 illustrated is mounted to a boom 226 which can position the rock bolter 202 at the desired location with respect to a rock surface 228 in the manner known in the art. Frequently, the boom 226 provides sufficiently rigid positioning of the rock bolter 202 that no additional stabilization is required. However, when additional stability is desired, the rock bolter 202 can be provided with a stinger 230 that is affixed to the feed shell 204 and can be extended to forcibly engage the rock surface 228.

While the novel features of the present invention have been described in terms of particular embodiments and preferred applications, it should be appreciated by one skilled in the art that substitution of materials and modification of details obviously can be made without departing from the spirit of the invention.

What I claim is:

1. A bolt centralizer for a rock bolter that installs bolts into a rock surface, the rock bolter establishing a work axis along which drilling and bolt-setting equipment traverse and aligning a bolt and associated bolt plate with the work axis after a hole into which the bolt is to be driven has been drilled along the work axis, the bolt centralizer comprising:

an arm having an arm first end and an arm second end, said arm first end being mounted to the rock bolter;

a bolt-directing hand having a hand first end and a hand second end, said hand first end being pivotably attached to said arm second end so as to pivot about a hand pivot axis;

a pair of fingers pivotably attached to said hand second end such that said fingers can pivot with respect to each other about a finger pivot axis between a closed position and an open position, said finger pivot axis being substantially normal to said hand pivot axis;

a spring for biasing said pair of fingers to said closed position;

a recess in each of said fingers configured such that, when said fingers are in said closed position, said recesses in combination form a centralizer passage sized to slidably engage the bolt when the bolt is positioned in said recesses, said fingers also being configured such that, when said fingers are in said open position, the bolt can be passed therebetween into or out of said recesses;

means for rotating said bolt-directing hand about said hand pivot axis between a first hand position, where said centralizer passage is aligned with the work axis when the bolt-setting equipment is aligned therewith, and a second hand position, where said bolt-directing hand and said fingers are positioned so as to not obstruct the advancement of the bolt-setting equipment and the bolt plate along the work axis; and means for locking said bolt-directing hand in said first hand position.

2. The bolt centralizer of claim 1 wherein said fingers each pivot about a common finger pivot axis, said common finger pivot axis being positioned such as to swing through a plane containing the work axis when said bolt-directing hand is pivoted about said hand pivot axis while the bolt-setting equipment is aligned with the work axis.

3. The bolt centralizer of claim 2 wherein said means for rotating said bolt-directing hand is a linear actuator pivotably connected to said bolt-directing hand and pivotably connected to the rock bolter at a point fixably positioned with respect to said arm, said linear actuator having at least one lockable position to provide said means for locking said bolt-directing hand in said first hand position.

4. The bolt centralizer of claim 3 wherein said linear actuator is connected such that said fingers are moved into closer proximity to the rock surface when said linear actuator is operated to rotate said bolt-directing hand from said first hand position to said second hand position.

5. The bolt centralizer of claim 4 wherein the rock bolter has a turret for sequentially positioning the drilling and bolt-setting equipment on the work axis and further wherein said arm first end is affixed to the turret such that the bolt centralizer rotates with the turret.

6. The bolt centralizer of claim 3 wherein said centralizer passage terminates in beveled surfaces that face the bolt when said bolt-directing hand is moved to said first hand position.

7. The bolt centralizer of claim 6 wherein said fingers are identical in form and each of said fingers further comprises:

a sloped surface adjacent said recess; and secondary bevels that intersect said sloped surface.

* * * * *